US010820125B2

(12) United States Patent
Henriksen

(10) Patent No.: US 10,820,125 B2
(45) Date of Patent: Oct. 27, 2020

(54) HEARING AID WITH HINGE LESS BATTERY DRAWER

(71) Applicant: Oticon A/S, Smørum (DK)

(72) Inventor: Poul Henriksen, Veksø (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/422,552

(22) Filed: May 24, 2019

(65) Prior Publication Data

US 2019/0364372 A1 Nov. 28, 2019

(30) Foreign Application Priority Data

May 25, 2018 (EP) ..... 18174302

(51) Int. Cl.
*H04R 25/00* (2006.01)

(52) U.S. Cl.
CPC ..... *H04R 25/602* (2013.01); *H04R 25/658* (2013.01); *H04R 2225/025* (2013.01)

(58) Field of Classification Search
CPC ..... H04R 25/602; H04R 25/658; H04R 2225/025
See application file for complete search history.

(56) References Cited

U.S. PATENT DOCUMENTS 8,170,251 B2 * 5/2012 Sattler ..... H04R 25/602 381/323
2018/0027345 A1 * 1/2018 Meskens ..... H04R 25/602 381/324

FOREIGN PATENT DOCUMENTS

DE 11 32 201 B 6/1962

* cited by examiner

*Primary Examiner* — Sunita Joshi

(74) *Attorney, Agent, or Firm* — Birch, Stewart, Kolasch & Birch, LLP.

(57) ABSTRACT

An in-the-ear (ITE) hearing aid comprising a body portion provided with a receiving space and a battery drawer configured to be received by the receiving space is disclosed. The battery drawer comprises a space configured to receive and maintain a battery in a fixed position. The battery drawer is slidably arranged in the receiving space of the body portion, in such a manner that the battery drawer is inserted into the receiving space in a slidable manner.

19 Claims, 6 Drawing Sheets

8
16
4
6
28
18
38
21
14
12'
12
10
46
40
44

2
4
6
8
12
12'
12''
18
20
22
22'
23
24
24'
26
36
X

HEARING AID WITH HINGE LESS BATTERY DRAWER

FIELD

The present disclosure relates to an in-the-ear (ITE) hearing aid comprising a body portion provided with a receiving space and a battery drawer configured to be received in the receiving space. More particularly, the disclosure relates to a hearing aid provided with a battery drawer of reduced size.

BACKGROUND

ITE hearing aids are small sized hearing aids, which are suitable for insertion into the ear canal, and can compensate for a hearing loss. ITE hearing aids are generally less visible than ordinary BTE style hearing aids, since the entire device are configured to be inserted into the ear canal. At the end of the hearing aid, which faces substantially outside of the ear canal, the ITE type hearing aids are often provided with a faceplate which is configured as a hinge-type battery drawer.

The battery drawer of an ITE hearing aid, often takes up a lot of space due to the structures needed for the battery door of the faceplate to be able to receive and remove a battery by a hinge mounted battery drawer. The hinge construction requires a relatively large area of material, which are used for the battery drawer to rotate around the hinge construction. Accordingly, the size of the ITE hearing aid is larger than preferred, since the smaller the ITE hearing aid, a larger variety of ear canals can be fitted, and at the same time the visual size of the hearing aid will appear smaller.

Therefore, it would be desirable to be able to provide an ITE hearing aid having a battery drawer of reduced size, which allows for a smaller hearing aid, that can be fitted to a larger variety of ear canal sizes. Accordingly, it is an object of the disclosure to provide an ITE hearing aid having a battery drawer of reduced size.

SUMMARY

Accordingly, an ITE hearing aid comprising a body portion provided with a receiving space, wherein the receiving space is defined by a first open end opposing a second at least partly closed end, wherein the battery drawer when inserted in the receiving space abuts the second closed end. Accordingly, a battery drawer, which is configured to be received in the receiving space is provided for an ITE type hearing aid together with an ITE hearing aid comprises such battery drawer construction. The battery drawer comprises a space configured to receive and maintain a battery in a fixed position, wherein the battery drawer is slidably arranged in the receiving space of the body portion, in such a manner that the battery drawer is inserted into the receiving space from the first open end of the battery drawer along a substantially longitudinal direction of the receiving space towards the at least partly closed end in a slidable motion.

Accordingly, the battery drawer is constructed such that the need for rotational movement around e.g. a hinge construction is not needed. Instead the battery drawer is slid into the receiving space in a motion as described above. This allows a battery construction, which uses less material in the frontal area (i.e. the faceplate of ordinary hearing aids), and the construction, which becomes more clearly defined in the following, also allows less material used for keeping the battery in place in the battery drawer. Therefore, by providing a slidable arranged battery drawer, a reduce the size of the battery drawer and thus the size of the body portion can be obtained, which ensures a smaller hearing aid enabling a larger fit in a variety of ear canals.

In more detail, the battery drawer comprises:

- an opening, through which opening the battery can be inserted into the battery drawer;
- an end structure opposing the opening and being configured to prevent the battery from moving out of the battery drawer when being moved in at least one radial direction;
- a first enclosing structure extending in extension of the end structure;
- a second enclosing structure substantially opposing the first enclosing structure and extending in extension of the end structure, wherein an open space is formed between the first enclosing structure and the second enclosing structure, and wherein the second enclosing structure has a smaller surface area than the second enclosing structure.

In other words, the battery drawer is constructed with an end portion, which "holds" the curved side of the battery, and from which two opposing sides extends. The two opposing first and second enclosing structures forms a first surface area, at which a flat side of the battery is supported and a second surface area, which are smaller than the first surface area, and which supports a second flat side of the battery.

By providing at least one side of the battery drawer with a substantialy small surface area as described above it is possible to achieve a battery drawer of reduced size due to omitted material structure in the battery drawer. In that regard, on could say that enclosing-free portions are created, where no material connection between the two enclosing structures exists. Accordingly, the end wall is configured together with at least a part of the enclosing structures to form a bag and/or container, where in the battery can be received. From the opening into bag and/or container, a first enclosing structure and a second enclosing structure extends towards the opening of the battery drawer, wherein the two extending enclosing structures are not connected by any material at the sides thereof, thereby leaving the battery drawer with an open space surrounded by two opposing enclosing structure.

For holding the battery drawer in place in the body portion of the hearing aid, the he battery drawer comprises one or more first attachment structures configured to engage with one or more corresponding second attachment structures provided in the body portion of the ITE hearing aid. This enables an easy insertion and removal of the battery drawer to/from the receiving space of the body portion of the hearing aid. Furthermore, it makes it possible to maintain the battery drawer in a fixed position in the ITE hearing aid.

The attachment structures may be of any suitable type and size. In one embodiment, the corresponding attachment structures are structures provided with corresponding barbed portions, so as grooves and protrusions, wherein the protrusion is formed in a substantially flexible manner enabling a snap fit engagement and release of the battery drawer from the receiving space of the body portion. In an embodiment, the first attachment structures and the second attachment structures may be configured as mechanical structures that engage with each other. The mechanical attachment structures can be used to maintain the battery drawer in a fixed position in the ITE hearing aid in an easy and user-friendly manner. The mechanical attachment structures may comprise one "male part" protruding from either a structure of the battery drawer or the hearing aid and a corresponding "female part" configured to receive the "male part". In one embodiment, the mechanical attachment structures comprise barbed portions.

In an embodiment the first attachment structures and/or the second attachment structures comprise a snapping feature.

Hereby, it is possible to provide a mechanical attachment of the battery drawer to the housing of the hearing aid. A snapping feature may comprise a snap-fit joint. In one embodiment, the first attachment structures and/or the second attachment structures are flexible and configured to be joined by pushing the structures in order to interlock the structures.

In an embodiment, the first attachment structures and/or the second attachment structures may be magnetic, allowing a magnetic attraction of the battery drawer and/or the battery itself to internal structure of the hearing aid. This enables an easy insertion of the battery drawer, which are "dragged" by magnetic forces into the receiving space The magnetic attachment structures may comprise corresponding plate members configured to be brought into engagement with each other (so that the corresponding plate member abut each other).

To reduce the amount of material needed for the battery drawer, and which normally takes up a lot of space in the hearing aid, the battery drawer does not surround the battery but comprises at least one open side structure. Application of one or more open side structure reduces the material to be used, which enables a smaller occupied frontal area, which allows for a smaller hearing aid.

According to an even further embodiment, at least one of the side structures (i.e. enclosing side structure) is configured with a hook configured, which ensures that the battery is kept in place in the batter drawer.

According to another embodiment, the hook comprises a stop portion. Application of stop portion makes it possible to restrict the radial displacement of the battery and hereby keep the battery in a fixed position with respect to the battery drawer. The stop portion may be an axially extending stop portion, which allows that the battery is kept in place in the battery drawer.

According to an even further embodiment, an opening is provided adjacent to the hook. Hereby, the battery can be inserted into the battery drawer in a manner, in which the hook can be deflected during insertion of the battery.

According to another embodiment, the first attachment structure is provided at an end wall of the battery drawer.

According to a further embodiment, the first attachment structure is provided at a side wall of the battery drawer.

According to an even further embodiment, the battery drawer comprises an additional opening providing access to the battery. In a preferred embodiment, the battery drawer comprises a side wall provided with an opening arranged in the central portion of it. Hereby, electrical connection can be established through the additional opening.

According to another embodiment, the space (groove) comprises an indentation for receiving a narrow portion of the battery. Hereby, the battery can be engagingly received by the battery drawer and indentation can prevent displacement of the battery.

According to an even further embodiment, the battery drawer comprises a nail grip. Hereby, removal of the battery drawer from the hearing aid is eased.

BRIEF DESCRIPTION OF DRAWINGS

The aspects and embodiments of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figures 1A, 1B, 1C:
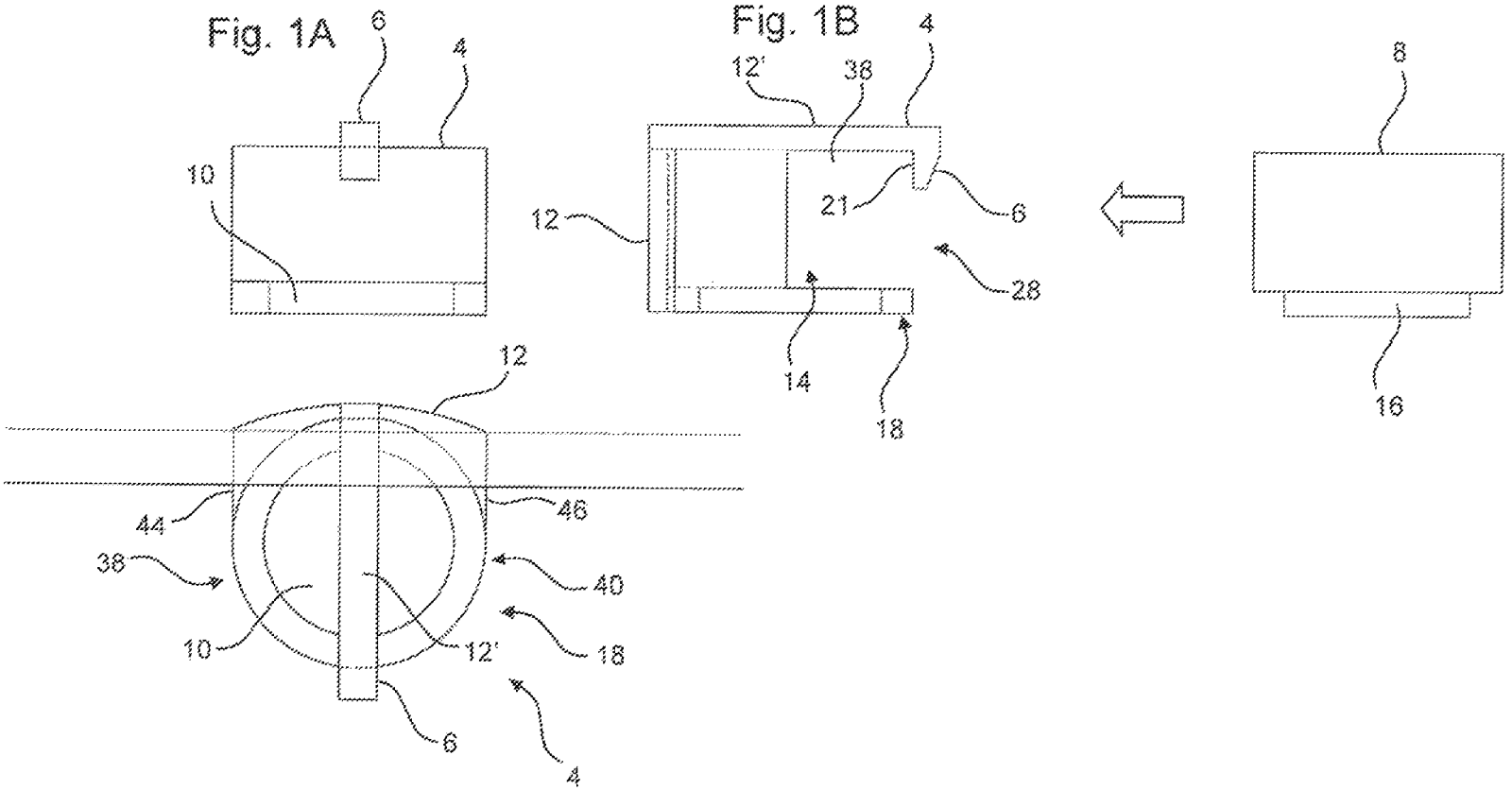
FIG. 1A shows a front view of a battery drawer according to an embodiment of the disclosure.
FIG. 1B shows a side view of the battery drawer shown in FIG. 1A.
FIG. 1C shows a top view of a battery drawer shown in FIG. 1A.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in an In-the-Ear type hearing aid.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously.

As will become apparent, the disclosure relates mainly to an ITE type hearing aid, but the solutions described herein could be used in other types of hearing aids, where there is a need to limit the material used in relation to the battery drawer.

Now referring to FIG. 1A, which illustrates a battery drawer 4 according to an embodiment of the disclosure. FIG. 1A illustrates a front view of a battery drawer 4 according to an embodiment of the disclosure. FIG. 1B illustrates a side view of the battery drawer 4 shown in FIG. 1A and FIG. 1C illustrates a top view of a battery drawer 4 shown in FIG. 1A.

The battery drawer 4 comprises a side structure 18 provided with a centrally arranged indentation 10 having a circular cross-sectional area. A first wall structure 44 (i.e. an enclosing structure) and a second wall structure 46 (i.e. a second enclosing structure) protrude from the side structure 18. The wall structures 44, 46 extend parallel to each other and perpendicular to the length of the side structure 18.

An end wall 12 connects the first wall structure 44 and the second wall structure 46. An elongated side wall 12' extends parallel to and opposing the side structure 18. A hook 6 is provided at the distal end of the elongated side wall 12'. The hook 6 comprises a stop portion 21 that extends perpendicular to the longitudinal axis of the elongated side wall 12' towards the side structure 18. Accordingly, the hook 6 and its stop portion 21 can keep a battery 8 maintained in the battery drawer 4 once the battery 8 has been inserted into the receiving space 14 of the battery drawer 4 through the opening 28 of the battery drawer 8.

The indentation 10 being centrally arranged in the side structure 18 is configured to receive the narrow portion 16 of the battery 8. Hereby, the indentation 10 is capable of preventing radial displacement of the battery 8 once the narrow portion 16 of the battery 8 has been received by the indentation 10.

It can be seen that the battery drawer 4 comprises a first wall-free portion 38 arranged next to the first wall structure 44 and that the battery drawer 4 comprises a second wall-free portion 40 arranged next to the second wall structure 46. Since the battery drawer 4 does not comprise a hinge structure for being rotatably mounted to a body portion of a hearing aid, the wall structures needed for a hinge structure can be omitted. Accordingly, the battery drawer 4 according to the disclosure can be made with "wall-free portions". Accordingly, the size of the battery drawer 4 can be decreased compared to the prior art battery drawers. In other words, the battery drawer is constructed with an end portion, which "holds" the curved side of the battery, and from which two opposing sides extends. The two opposing first and second enclosing structures forms a first surface area, at which a flat side of the battery is supported and a second surface area, which are smaller than the first surface area, and which supports a second flat side of the battery.

Figure 2:
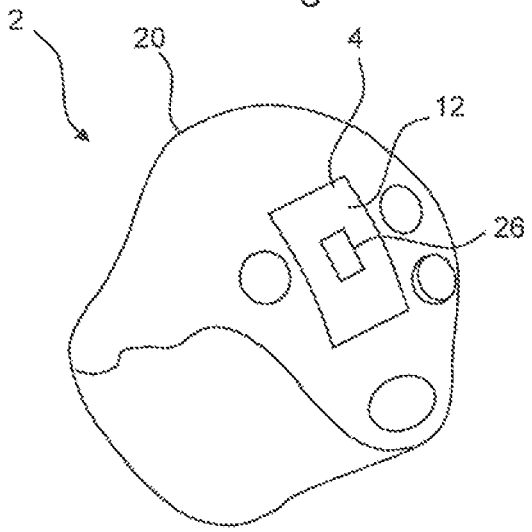
FIG. 2 shows a hearing aid according to the disclosure.

FIG. 2 illustrates a hearing aid 2 according to the disclosure. The hearing aid 2 comprises a body portion 20 (a housing) that is provided with an opening configured to receive a battery drawer 4. A battery drawer 4 has been inserted into the opening. The battery drawer 4 comprises a hook 6 corresponding to the one shown in FIG. 1B. However, the hook cannot be seen in FIG. 2 since it is slided into the opening of the body portion when the battery drawer is inserted therein.

FIG. 2 furthermore illustrates a hearing aid 2 according to the disclosure where the end wall 12 of the battery drawer 4 forms the top surface of the battery drawer and is substantially flush with the body (i.e. housing) of the hearing aid. It can be seen, that a nail grip 26 is provided at the end wall 12. Hereby, the nail grip 26 can be used to draw the battery drawer 4 out of the opening in the body portion 20 of the hearing aid 2. The nail grip 26 is arranged substantially in the center of the end wall 12 of the battery drawer, but is should be noted that the nail grip could also be placed along the contours of the end wall.

Figure 3:
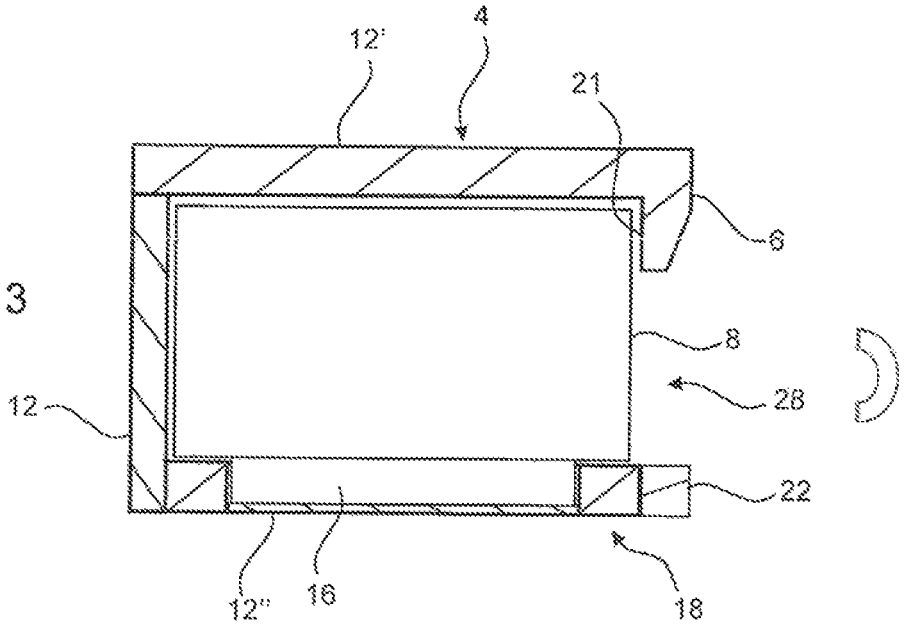
FIG. 3 shows a cross-sectional view of a battery drawer according to the disclosure.

FIG. 3 illustrates a cross-sectional view of a battery drawer 4 according to the disclosure. The battery drawer 4 comprises a side structure 18 provided with an indentation configured to receive a narrow portion 16 of a battery 8. The side structure 18 comprises a first side wall 12" extending along the length of the indentation. The side structure 18 comprises a first portion and a second portion provided adjacent to the proximal and distal portion of the first side wall 12".

The battery drawer 4 comprises a second side wall 12' extending parallel to the first side wall 12". A hook 6 is provided in the distal end of the second side wall 12'. The hook 6 extends perpendicular to the second side wall 12' and is provided with a stop portion 21 configured to restrict the radial displacement of the battery 8, and thus to maintain the battery in the battery drawer The battery 8 can be inserted into the battery drawer 4 through the opening 28 of the battery drawer 4. When the battery 8 has been inserted into the battery drawer 4, the narrow portion 16 of the battery 8 will be received in the indentation of the battery drawer 4. The hook 6, the inside surface of the end wall 12 as well as the first portion and the second portion provided adjacent to the first side wall 12" restricts a movement of the battery 8. Likewise, the second side wall 12' and the first side wall 12" restricts the axial displacement of the battery 8.

FIG. 3 furthermore illustrates how the battery drawer comprises a first attachment structure 22 comprising a magnetic or magnetizable material (e.g. a ferromagnetic material such as iron). The first attachment structure 22 enables the battery drawer 4 to be detachably attached to a corresponding magnetic or magnetizable structure provided inside the opening of a hearing aid, as illustrated by the half circle in FIG. 3. It should be noted that the half circle illustrated in FIG. 3 is arranged in the receiving space of the body portion of the hearing aid, and is configured to magnetically attract the battery itself, and/or an attachment structure 22 as described above.

Figures 4A, 4B, 4C, 4D:
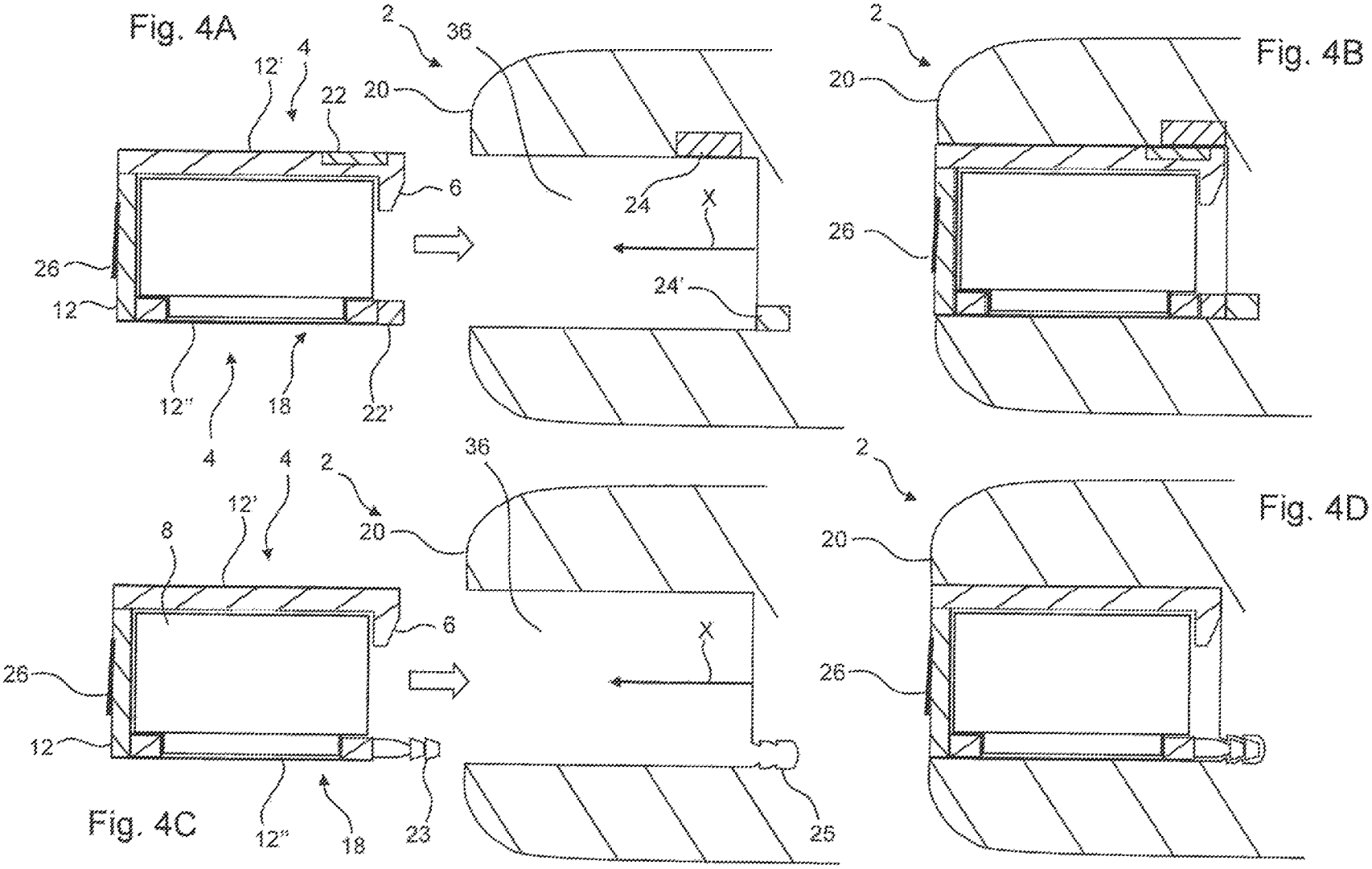
FIG. 4A shows a cross-sectional view of another hearing aid according to the disclosure wherein the battery drawer is being inserted into the body portion of the hearing aid.
FIG. 4B shows a cross-sectional view of the hearing aid shown in FIG. 4A in a configuration, in which the battery drawer has been inserted into the body portion of the hearing aid.
FIG. 4C shows a cross-sectional view of another hearing aid according to the disclosure wherein the battery drawer is being inserted into the body portion of the hearing aid.
FIG. 4D shows a cross-sectional view of the hearing aid shown in FIG. 4C in a configuration, in which the battery drawer has been inserted into the body portion of the hearing aid.

FIG. 4A illustrates a cross-sectional view of a hearing aid 2 according to the disclosure wherein the battery drawer 4 is being inserted into the body portion 20 of the hearing aid 2. The battery drawer 4 basically corresponds to the one shown in FIG. 3, however, it comprises a nail grip 26 provided on the end wall 12, an attachment structure 22 provided at the side wall 12' and an attachment structure 22' protruding from the distal portion of the side structure 18.

The battery drawer 4 is configured to be detachably inserted into a receiving space 36 provided in the body portion 20 of the hearing aid 2. The battery drawer 4 can be inserted into the receiving space 36 by being moved parallel to the longitudinal axis X of the receiving space 36 in a direction as indicated by the arrow in FIG. 4A.

When the battery drawer 4 has been detachably inserted into the receiving space 36 of the hearing aid 2, like illustrated in FIG. 4B (illustrating a cross-sectional view of the hearing aid 2 shown in FIG. 4A in a configuration, in which the battery drawer 4 has been inserted into the body portion 20 of the hearing aid 2), the attachment structures 22, 22' of the battery drawer 4 are brought into engagement with corresponding magnetic or magnetizable attachment structures 24, 24' of the hearing aid 2.

FIG. 4C illustrates a cross-sectional view of another hearing aid 2 according to the disclosure wherein the battery drawer 4 is being inserted into the body portion 20 of the hearing aid 2. The battery drawer 4 basically corresponds to the battery drawer shown in FIG. 4A. The attachment structures 22, 22' have, however, been replaced with a single mechanical attachment structure 23 provided with a compressible barbed portion configured to be brought into engagement with a corresponding second attachment structure 25 provided in the hearing aid 2. It should be noted that that the barbed portions preferably are made from a flexible material which allow the battery drawer to be moved into and removed from the receiving space in the body portion of the hearing aid, so as to allow for a change of the battery in the battery drawer. Accordingly, the battery drawer 4 can be detachably attached to the hearing aid 2 by means of the corresponding attachment structures 23, 25.

FIG. 4D illustrates a cross-sectional view of the hearing aid 2 shown in FIG. 4C in a configuration, in which the battery drawer 4 has been inserted into the body portion 20 of the hearing aid 2.

Figure 5B:
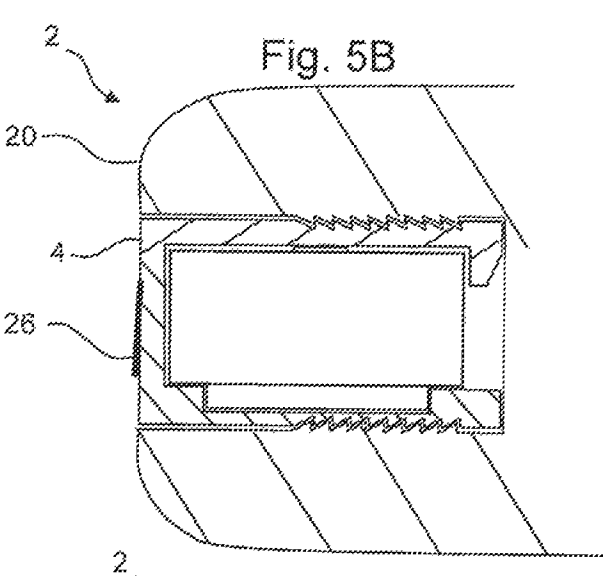
FIG. 5B shows a cross-sectional view of the hearing aid shown in FIG. 5A in a configuration, in which the battery drawer has been inserted into the body portion of the hearing aid.
Figure 5A:
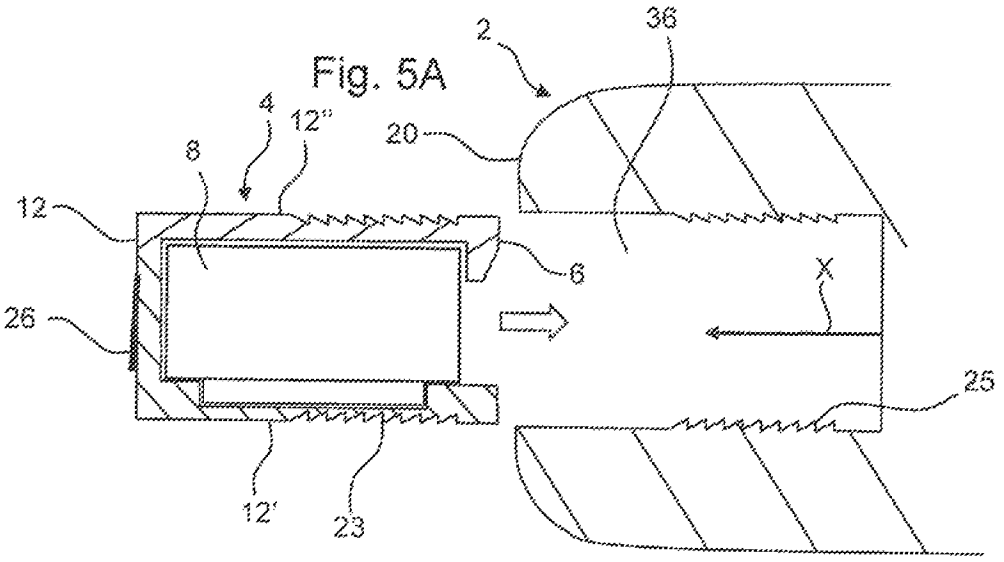
FIG. 5A shows a cross-sectional view of another hearing aid according to the disclosure wherein the battery drawer is being inserted into the body portion of the hearing aid.

FIG. 5A illustrates a cross-sectional view of a hearing aid 2 according to the disclosure wherein the battery drawer 4 is being inserted into the body portion 20 of the hearing aid 2.

The battery drawer 4 basically corresponds to the battery drawer shown in FIG. 4A. The attachment structures 22, 22' have, however, been replaced with attachment structures 23 arranged on the side walls 12', 12". The attachment structures 23 are configured to be detachably attached to corresponding attachment structures 25 provided in the hearing aid 2. Thus, the battery drawer 4 can be detachably attached to the hearing aid 2 by means of the corresponding attachment structures 23, 25. Again it should be noted that the attachment structure preferably are made from a flexible material allowing an easy insertion and removal of the battery drawer from the receiving portion of the body portion of the hearing aid.

FIG. 5B illustrates a cross-sectional view of the hearing aid 2 shown in FIG. 5A in a configuration, in which the battery drawer 4 has been inserted into the body portion 20 of the hearing aid 2.

Figure 5D:
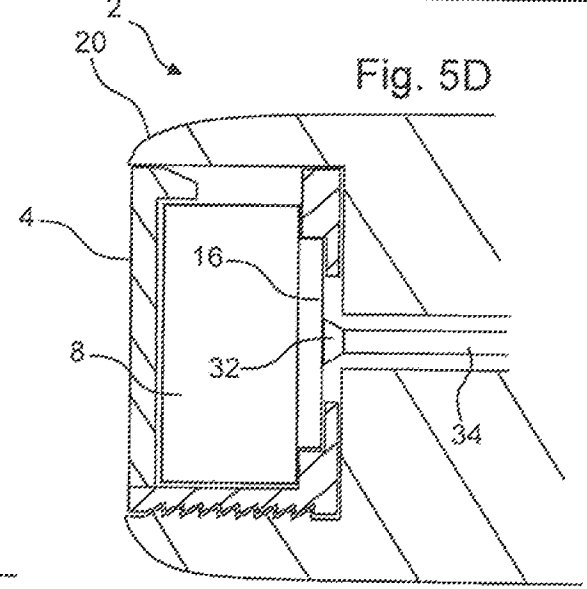
FIG. 5D shows a cross-sectional view of the hearing aid shown in FIG. 5C in a configuration, in which the battery drawer has been inserted into the body portion of the hearing aid.
Figure 5C:
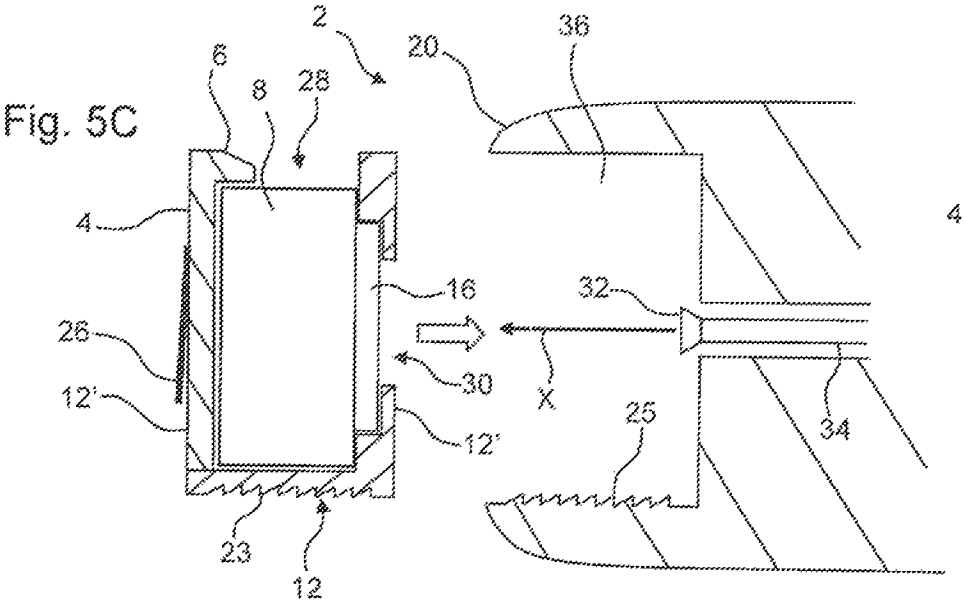
FIG. 5C shows a cross-sectional view of another hearing aid according to the disclosure wherein the battery drawer is being inserted into the body portion of the hearing aid.

FIG. 5C illustrates a cross-sectional view of a hearing aid 2 according to the disclosure wherein the battery drawer 4 is being inserted into the body portion 20 of the hearing aid 2.

The battery drawer 4 basically corresponds to the battery drawer shown in FIG. 4A except for the side wall 12' which has been modified by providing an opening 30 in the central portion of it. Furthermore, the nail grip 26 has been arranged on the second side wall 12', whereas the attachment structure 23 has been provided on the end wall 12. Moreover, the battery drawer 4 has been rotated 90 degrees so that the axial surface of the battery 8 faces the opening in the hearing aid 2 when the battery drawer 4 is inserted into the opening.

The hearing aid 2 is provided with an attachment structure 25 configured to engage with the attachment structure 23 of the battery drawer 4. The hearing aid 2 more over is provided with an electrical contact member 32 provided at the distal end of a cable 34. The electrical contact member 32 is arranged and configured to be brought electrically connected with the narrow portion 16 of the battery 8.

Thus, the battery drawer 4 can be detachably attached to the hearing aid 2 by means of the corresponding attachment structures 23, 25. At the same time, an electrical connection is established between the electrical contact member 32 and the narrow portion 16 of the battery 8.

FIG. 5D illustrates a cross-sectional view of the hearing aid 2 shown in FIG. 5C in a configuration, in which the battery drawer 4 has been inserted into the body portion 20 of the hearing aid 2.

Figure 6B:
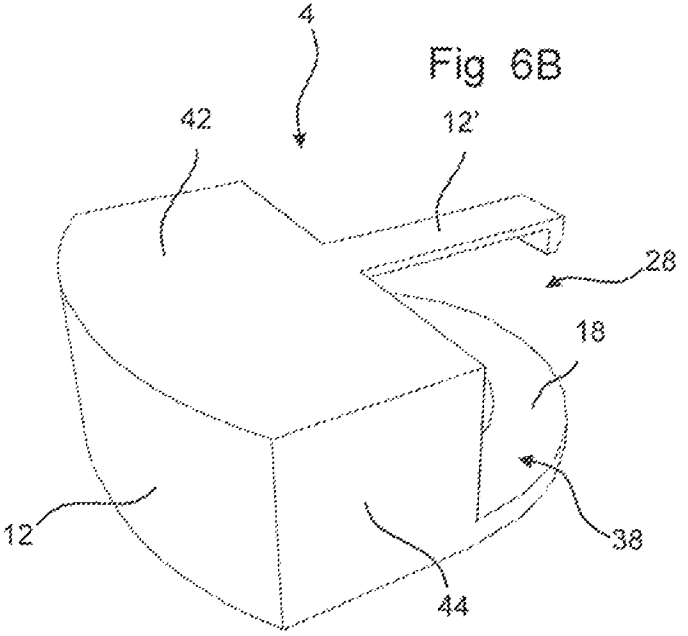
FIG. 6B shows a second perspective view of the battery drawer shown in FIG. 6A.
Figure 6D:
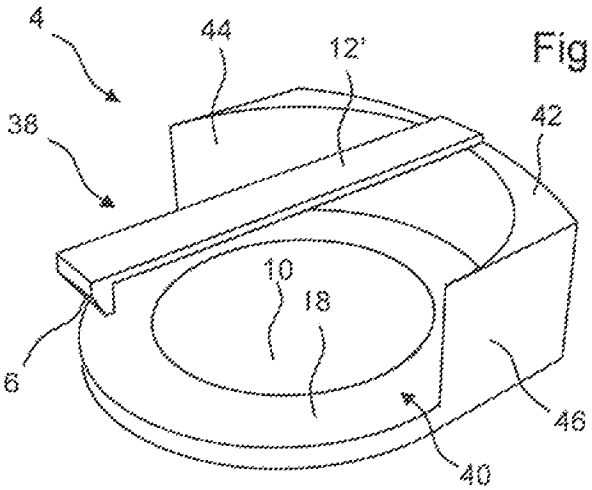
FIG. 6D shows a perspective view of another battery drawer according to an embodiment of the disclosure.
Figure 6A:
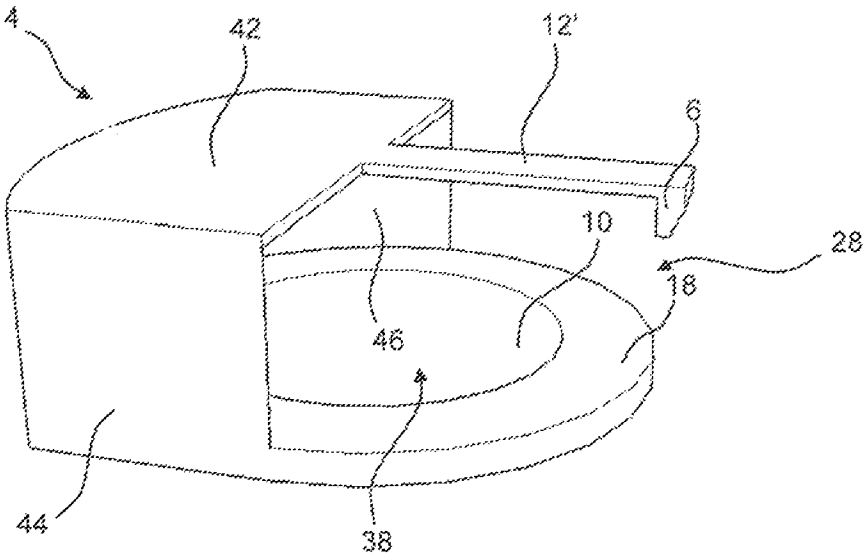
FIG. 6A shows a first perspective view of a battery drawer according to an embodiment of the disclosure.
Figure 6C:
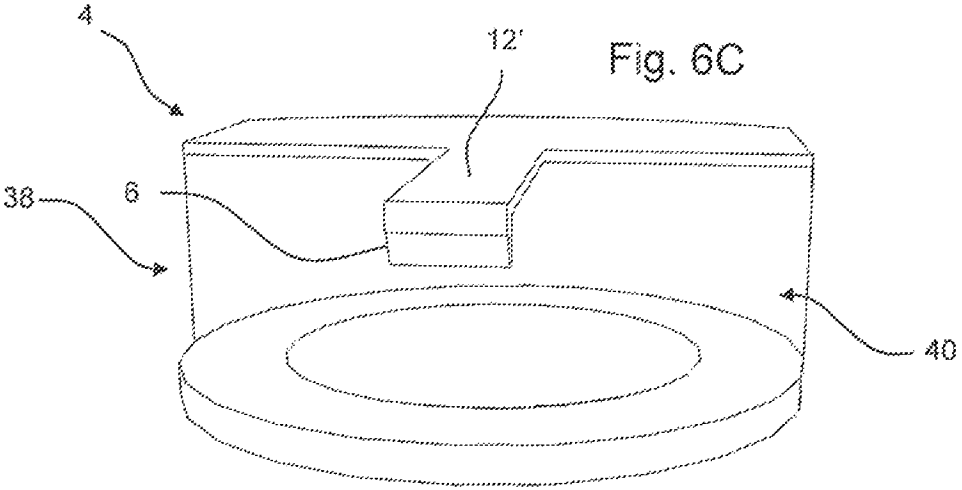
FIG. 6C shows a third perspective view of the battery drawer shown in FIG. 6A.

FIG. 6A illustrates a first perspective view of a battery drawer 4 according to an embodiment of the disclosure. FIG. 6B illustrates a second perspective view of the battery drawer shown in FIG. 6A and FIG. 6C illustrates a third perspective view of the battery drawer shown in FIG. 6A.

The battery drawer 4 comprises a side structure 18 provided with a centrally arranged indentation 10 having a circular cross-sectional area configured to receive a portion of a battery to be arranged in the battery drawer 4.

A first wall structure 44 and a second wall structure 46 protrude from the side structure 18. The wall structures 44, 46 extend parallel to each other and perpendicular to the length the side structure 18.

An arced end wall 12 connects the first wall structure 44 and the second wall structure 46, wherein a closing plate 42 extends parallel to the side structure 18. An elongated side wall 12' extends parallel to the side structure 18 in extension of the closing plate 42.

A hook 6 having a stop portion 21 extending perpendicular to the longitudinal axis of the elongated side wall 12' towards the side structure 18 is provided at the distal end of the elongated side wall 12'. Thus, the hook 6 and its stop portion 21 are configured to maintain a battery in the battery drawer 4. It is possible to insert a battery into the receiving space of the battery drawer 4 through the opening 28 of the battery drawer 8.

The indentation 10 is centrally arranged in the side structure 18 and thus the indentation 10 is configured to receive a narrow portion of the battery (see FIG. 1B). Accordingly, the indentation 10 is configured to prevent radial displacement of a battery once the narrow portion of the battery has been received by the indentation 10.

The battery drawer 4 comprises a first wall-free portion 38 arranged next to the first wall structure 44 and that the battery drawer 4 comprises a second wall-free portion 40 arranged next to the second wall structure 46.

FIG. 6D illustrates a perspective view of another battery drawer 4 according to an embodiment of the disclosure. The battery drawer 4 basically corresponds to the one shown in FIG. 6A. The size (area) of the closing plate 42, however, is reduced.

Figure 7:
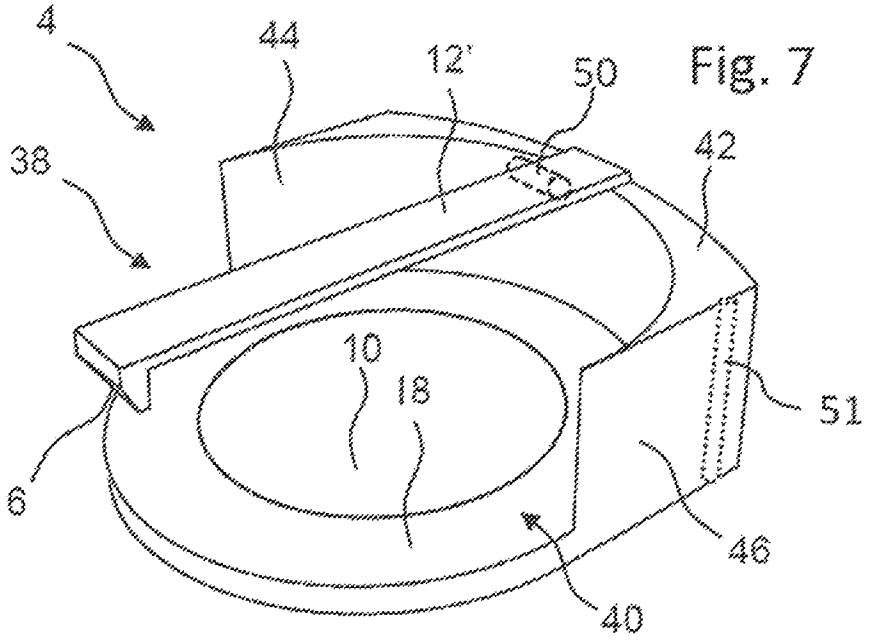
FIG. 7 shows a view of the battery drawer according to an embodiment.

Finally, FIG. 7 illustrates a battery drawer substantially in line with the embodiment of FIG. 6D. As already elaborated on the battery drawer comprises an end wall, which is configured with a closing plate 42, from where a first wall structure 44 and a second wall structure 46 extends. The closing plate (also forming part of the end wall 12) together with the wall structures 44, 46 forms a bag and/or container, wherein the battery can be received. From the opening into bag and/or container, a first enclosing structure 18 (also denoted a side structure) and a second enclosing structure 12' (also denoted side wall) extends towards the opening of the battery drawer, wherein the two extending enclosing structures 18, 12' are not connected by any material at the sides thereof, thereby leaving the battery drawer with an open space surrounded by two opposing enclosing structure. In line with the previous described embodiments, the enclosing structures are thus separated by "wall-free" portions 38, 40 creating the previous mentioned open space. In addition to these previously described feature, the embodiment of FIG. 7 also illustrated how one or more attachment structures 50, 51 may be configured as part of the battery drawer.

Accordingly, in one embodiment, an attachment structure 51 can be arranged on the wall structure 46, so as to be able to engage into a corresponding groove in the body portion of the hearing aid, when the battery drawer is inserted therein.

In another embodiment, the attachment structure 50 may be arranged on the enclosing structure 12' (also configured as a hook structure). Both of the attachment structure 50, 51 is configured as a protrusion which engages with a corresponding groove in the body portion of the hearing aid.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may", means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. An in-the-ear (ITE) hearing aid comprising a body portion provided with a receiving space, said receiving space being defined by a first open end opposing a second at least partly closed end, and a battery drawer configured to be received in the receiving space, wherein the battery drawer comprises an opening, through which the battery can be inserted into the battery drawer;

an end structure opposing the opening and being configured to prevent the battery from moving out of the battery drawer when being moved in at least one radial direction;

a first enclosing structure extending in extension of the end structure;

a second enclosing structure substantially opposing the first enclosing structure and extending in extension of the end structure, wherein an open space is formed between the first enclosing structure and the second enclosing structure, the second enclosing structure has a smaller surface area than the first enclosing structure, and the battery drawer is slidably arranged in the receiving space of the body portion, in such a manner that the battery drawer is inserted into the receiving space from said first open end along a substantially longitudinal direction of said receiving space towards said at least partly closed end in a slidable motion.

2. An ITE hearing aid according to claim 1, wherein the battery drawer comprises one or more first attachment structures configured to engage with one or more second corresponding attachment structures provided in the body portion of the ITE hearing aid.

3. An ITE hearing aid according to claim 2, wherein the first attachment structures and/or the second attachment structures are magnetic.

4. An ITE hearing aid according to claim 2, wherein the first attachment structures and the second attachment structures are mechanical structures that engage with each other.

5. An ITE hearing aid according to claim 2, wherein the first attachment structures and/or the second attachment structures comprise a snapping feature.

6. An ITE hearing aid according to claim 1, wherein the battery drawer does not surround the battery but comprises at least one open side structure.

7. An ITE hearing aid according to claim 1, wherein at least one of the enclosing side structures is configured with a hook configured to restrict the motion of the battery.

8. An ITE hearing aid according to claim 7, wherein the hook comprises a stop portion.

9. An ITE hearing aid according to claim 7, wherein an opening is provided adjacent to the hook.

10. An ITE hearing aid according to claim 2, wherein the first attachment structure is provided at an end wall of the battery drawer.

11. An ITE hearing aid according to claim 2, wherein the first attachment structure is provided at a side wall of the battery drawer.

12. An ITE hearing aid according to claim 1, wherein the battery drawer comprises an additional opening providing access to the battery.

13. An ITE hearing aid according to claim 1, wherein the space comprises an indentation for receiving a narrow portion of the battery.

14. An ITE hearing aid according to claim 1, wherein the battery drawer comprises a nail grip.

15. An ITE hearing aid according to claim 1, wherein the battery drawer comprises one or more first attachment structures configured to engage with one or more second corresponding attachment structures provided in the body portion of the ITE hearing aid.

16. An ITE hearing aid according to claim 1, wherein the first attachment structures and/or the second attachment structures are magnetic.

17. An ITE hearing aid according to claim 2, wherein the first attachment structures and/or the second attachment structures are magnetic.

18. An ITE hearing aid according to claim 1, wherein the first attachment structures and the second attachment structures are mechanical structures that engage with each other.

19. An ITE hearing aid according to claim 2, wherein the first attachment structures and the second attachment structures are mechanical structures that engage with each other.

* * * * *